United States Patent [19]

Stockman et al.

[11] 4,006,690

[45] Feb. 8, 1977

[54] MECHANISM FOR FIRING A PROJECTILE SUCH AS A RIFLE GRENADE

[76] Inventors: Suzanne Stockman; Leon Stockman, both of 156, avenue des Aubepines, 1180 Brussels, Belgium

[22] Filed: May 6, 1975

[21] Appl. No.: 575,015

[30] Foreign Application Priority Data

May 6, 1974 Belgium ..... 143966
Apr. 23, 1975 Belgium ..... 155660

[52] U.S. Cl. ..... 102/80; 102/78
[51] Int. Cl.[2] ..... F42C 15/26
[58] Field of Search ..... 102/78, 80, 73 R, 73 A, 102/76 R

[56] References Cited

UNITED STATES PATENTS

| | | | |
|---|---|---|---|
| 2,709,962 | 6/1955 | Funk et al. | 102/78 |
| 2,715,873 | 8/1955 | Thompson | 102/80 X |
| 2,806,427 | 9/1957 | Hager | 102/80 X |
| 2,812,714 | 11/1957 | Wheatley et al. | 102/80 |
| 3,103,172 | 9/1963 | Hutchison et al. | 102/78 X |
| 3,375,786 | 4/1968 | Marchiaro | 102/78 |
| 3,715,988 | 2/1973 | Bares | 102/78 X |
| 3,732,825 | 5/1973 | Apotheloz | 102/80 |

*Primary Examiner*—David H. Brown
*Attorney, Agent, or Firm*—Walter Becker

[57] ABSTRACT

A device for firing a rifle grenade wherein a detonator is brought into an operative working position automatically a predetermined time after the start of the grenade through the action of a gravity force directed along the center line axis of the grenade.

12 Claims, 3 Drawing Figures

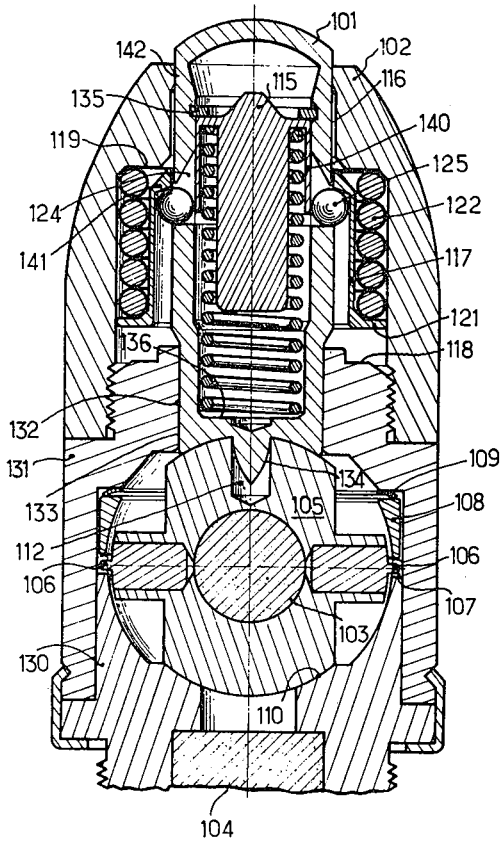

MECHANISM FOR FIRING A PROJECTILE SUCH AS A RIFLE GRENADE

The invention relates essentially to a mechanism for firing a projectile or missile such as a rifle grenade or the like the head or nose fuse of which comprises this mechanism which is adapted to make the projectile or missile explode upon impact at the end of the path of travel provided that this impact spot be far or remote enough from the shooter.

The object of the invention is a mechanism for firing a projectile or missile which enables to ignite the charge or filler contained within the projectile only when the latter has travelled some distance from the shooting spot.

For this purpose the mechanism for firing a projectile according to the invention such as a rifle grenade including a striker or plunger placed along the centre line axis of the projectile and projecting from the front end of the latter, a detonator associated with the striker or plunger and fired by the latter when the front end of the projectile hite or impinges upon an obstacle and a charge or filler ignited by the detonator, is characterized in that the detonator is mounted so as to be movable between two positions the first one of which is a safety position preventing the firing of the charge in case of percussion when the projectile has not been shot whereas the second one of which is an operative position enabling to ignite the charge when the projectile has been shot, the detonator being brought to the second position automatically some time after the start of the projectile only by the action of a gravity force directed substantially along the centre line axis of the projectile on its path of travel and arising from its slowing down itself due to the resistance of the air.

One object of the invention is indeed also to cause the detonator when it has been released after the start of the projectile to locate by itself in operative or firing position only at the end of a constant and predetermined time period. For the safeness of the shot it matters greatly that the projectile be cocked only some time after its start and that this characteristic feature be retained in all identical projectiles whatever the conditions of their shots may be.

According to another characterizing feature of the invention the firing mechanism comprises a striker locking device which includes a first inertia block movable inside of the striker between a front stop or abutment and the bottom of the striker or plunger, a calibrated return spring for biasing the inertia block towards said abutment or stop, a second annular inertia block surrounding the striker or plunger inside of the projectile and mounted for motion between a front shoulder and a rear shoulder of the projectile body, slots or openings formed through the striker body and receiving or accommodating locking balls kept or retained in said slots between the first inertia block and the second inertia block when the striker and the detonator are in a safety position before the shooting of the projectile, the first inertia block having between said front stop and the bottom of the striker a relatively very long stroke and uncovering said slots of the striker to release the locking balls only at the end of the stroke so that the locking device on the one hand remains insensitive to very violent and very short accelerations such as those caused by a shock prior to shooting the projectile and on the other hand releases the spherical part carrying the detonator only after the bounce at the end of the acceleration thereby enabling the detonator to be in operative position only at the end of a constant and predetermined time interval after the start of the projectile.

Thus in this improved firing mechanism the inertia block internally of the striker has to travel over a relatively long path due to inertia when an acceleration is applied thereto before being able to uncover the slots of the striker for releasing the locking balls hence causing the projectile to be cocked.

The invention will be better understood and further objects, characterizing features, details and advantages thereof will appear more clearly as the following explanatory description proceeds with reference to the accompanying drawings given by way of non-limitative example only illustrating a presently preferred specific form of embodiment and wherein:

FIG. 1 is a view in longitudinal section through the front portion of a rifle grenade, showing the firing mechanism in its safety position before the start of the projectile;

FIG. 2 is a view in longitudinal section similar to that of FIG. 1 but showing the firing mechanism in the position it assumes after firing the shot; and FIG. 3 is a view in longitudinal section similar to those of FIGS. 1 and 2 but showing the firing mechanism in its working position.

The head or nose fuse of a rifle grenade comprises an axial striker or plunger 101 projecting from the front portion 102 of the grenade and mounted for sliding motion inside of that part 102. The detonator 103 accommodated within a diametral bore of a substantially spherical member 105 is placed between the point or tip of the lower portion of the striker and the charge 104 of the grenade. The spherical part 105 or rotary drum is mounted for rotation about an axis extending at right angles to the longitudinal centre line axis of the projectile by means of a pair of very fine diametrally opposite pivots 106 consisting of two fine studs projecting from the surface of the drum 105 and accommodated within two diametrally opposite longitudinal notches 107 of a stationary element 130 of the body of the grenade which also comprises a lower portion 110 in the shape of a spherical cap on which is bearing the rotary drum 105 when the mechanism is in the safety position shown in FIG. 1. The notches 107 of the member 130 are normally closed at their upper portion by an annular member 108 surrounding the rotary drum 105 and pressed or urged towards the member 130 by a resilient annular washer 109 positioned between the member 108 and a shoulder of a stationary portion 131 of the nose fuse. This stationary portion 131 is secured, for instance set or crimped onto the lower portion 130 holding the charge 104 and it comprises an axial bore 132 for guiding the sliding motion of the striker 101. Said part 102 of ogival shape is screw-threaded onto that portion 131.

The striker terminates at its lower end in a concave surface having the shape of a spherical cap 133 comprising a central stud or tip 134 adapted to project or extend into a blind hole 112 of the rotary drum 105. In the safety position shown in FIG. 1 the concave surface 133 of the striker 101 is bearing upon the spherical surface of the drum 105, the stud or tip 134 being received in the blind hole 112.

The locking device for holding the striker in its safety position comprises a first inertia block 115 which is accommodated inside of the striker 101 while being slidably movable inside thereof between a first position defined by a stop or abutment 135 of the striker and a rear end position defined by the inner face 136 of the bottom of the striker. A biasing spring 116 is arranged between the inertia block 115 and the bottom of the striker and urges or pushes this inertia block towards the front stop 135.

A second inertia block 117 is placed about the striker 101 inside of the part 102 and is movable between a first forward position shown in FIG. 1 and a rear position shown in FIG. 2 where it is caused to bear upon an upper shoulder 118 of said member 131. A resiliently compressible element 122 is located between a flange or shoulder 121 of the inertia block 117 and an inner upper shoulder 119 of the ogival part 102. This resilient element 122 does not perform the function of a compression spring but only that of a resiliently compressible member the normal state or condition of which is shown in FIGS. 1, 2 and 3.

Within its tubular wall the striker 101 comprises at least two diametrally opposite slots 124 which are adapted to receive locking balls 125. The top portions of the slots 124 form sloping ramps directed upwards and inwards of the striker 101 with a slightly rounded shape corresponding to the spherical surface of the balls 125. The latter are kept or retained within the slots 124 in locking position as shown in FIG. 1 on the one hand by an outer wall 140 of the first inertia block 115 and on the other hand by an upper flange 141 of the second inertia block 117. This flange 141 is of a substantially tapering or frusto-conical shape and its inner wall is bearing with a substantially linear contact onto the surfaces of the balls 125 when the locking device is in the safety position shown in FIG. 1. Thus the flange 141 of the outer inertia block 117 may bear upon the balls 125 without any risk of being crushed or squeezed.

It should be noted that the outer tubular wall 140 of the first inertia block 115 has a certain height and is in contact with the balls 125 in the position shown in FIG. 1 through the lower portion of this tubular wall 140. Thus the inertia block 115 has to travel a relatively long distance towards the bottom of the striker while squeezing the spring 116 in order that the slots 124 of the striker be uncovered by this wall 140.

It should also be noted that the outer inertia block 117 is made with as light a weight as possible.

Finally the striker 101 which is already guided in sliding motion at its lower portion within the bore 132 of the member 131 is also guided in sliding motion within the cylindrical opening 142 of the upper portion of the member 102. The front end of the striker is cylindrical and then widens or flares out to become slightly tapering or frusto-conical right above the slots 124 so as to brake the forward outward motion of the striker and to lock the latter in the outward extended position shown in FIG. 3.

The operation of this firing mechanism is the following:

Before use the mechanism is in the position shown in FIG. 1, i.e. the rotary drum 105 carrying the detonator 103 is kept in bearing engagement with the spherical portion 110 of the member 130 and therefore fully closes the access to the charge 104. The striker 101 is kept in the retracted or driven-in position with its point or tip 134 accommodated in the blind hole 112 of the drum 105 by the locking device which has just been described and in which the balls 125 housed in the slots 124 of the striker are retained between the tubular wall 140 of the first inertia block 115 and the top flange 141 of the second inertia block 117. In this position the rotary drum 105 is held against rotation by the striker itself held against translatory motion by the joint or combined action of the inertia blocks 115 and 117 and of the balls 125.

In this position the firing mechanism remains insensitive to shocks and vibrations thereby making unnecessary the use of safety pins the inconveniences of which are very great. When this mechanism is indeed subjected to a shock for instance when the grenade falls accidently down from a great height on its tail or base the acceleration the mechanism is undergoing at the time of the shock may be very large of about 40,000 to 60,000 times the acceleration of the earth's weight or terrestrial gravity but is of an extreme shortness. This very large acceleration acts upon the inner inertia block 115 imparting it a very high speed almost instantaneously. However hardly has the inertia block 115 begun its displacement towards the bottom of the striker when the acceleration stops. The inertia block 115 keeps however moving by its own momentum, i.e. under its own impetus while squeezing the spring 116. Owing however to the very long stroke of the inertia block 115 which is required for uncovering the slots 124 of the striker and accordingly to release the locking balls 125 this inertia block stops moving towards the bottom of the striker before having uncovered the slots 124. It then assumes again its initial position on the abutment 135 of the striker 101 hence before having released the balls 125. The very large acceleration caused by the shock is also acting upon the outer inertia block 117 as well as upon the resilient element 122 which holds it in pressed engagement with the balls 125. It should however be noted that the inertia block 117 cannot move for it is retained by the balls 125 which may not move out of the slots 124. It is for this ground that one endeavours to give the outer inertia block 117 an as light a weight as possible. This very reduced weight will however still be large enough for push-the balls 125 back without any difficulty when the slots 124 are uncovered by the tubular wall 140 of the first inertia block 115.

It should also be noted that according to the invention the spring 116 has a force which is about 1,000 times the weight of the inertia block 115. Thus the shocks reflected by or resulting in an acceleration of a value lower than 1,000 g (*g* being the earth's gravity acceleration) whatever numerous they may be will be unable to shake or set in motion the inertia block 115 and to move it towards the bottom of the striker. Likewise the resilient element 122 will also have a force which will be about 1,000 times the weight of the whole assembly consisting of the striker or plunger 101, its content, the rotary drum 105 and the outer inertia block 117. Thus no shock reflected by or resulting in an acceleration of a value lower than 1,000 g will be able to displace this whole assembly.

At the time of shooting the grenade the striker or plunger 101 and the rotary drum 105 are therefore bearing or pressed against the spherical portion 110 of the member 130. The launching or starting thrust is reflected by a strong acceleration and the inertia block 115 then moves through inertial displacement towards the bottom of the striker while squeezing its spring 116. The starting thrust lasts as long as the projectile has not left the weapon so that the inertia block 115 moves until it is abutting against the face 136 of the bottom of the striker and fully uncovers the slots 124 of this striker. The outer inertia block 117 also moves rearwards of the projectile through inertial displacement under the effect of the acceleration and then pushes back with its flange 141 the balls 125 rearwards of the striker as shown in FIG. 2. The angle of bearing of the flange 141 of the inertia block 117 upon the balls is determined so as to be close to the limit locking angle while keeping a safety margin.

The outer inertia block 117 moved downwards in abutment with the shoulder 118 of the member 131 at least partially closes the slots 124 of the striker thereby making impossible any new gripping action by the balls 125 caused to be housed within the slots 124.

At the end of the acceleration imparted to the grenade the following phenomenon occurs: the body of the grenade on which is secured the fuse of the grenade has been resiliently deformed to a very small extent under the effect of the acceleration. The inertia block 115 is at the bottom of the striker 101, its spring 116 being fully squeezed. The striker 101 and the rotary drum 105 are bearing upon the spherical surface 110 under the action of the acceleration and of the spring 116. As soon as the acceleration stops the elastic deformation of the body of the grenade vanishes instantaneously while tending to fling forward the drum 105 and the striker 101. The spring 116 of the inertia block 115 is however always compressed the return or backward motion of this inertia block 115 towards the abutment 135 having hardly begun. Consequently if the pressure of the spring 116 is stronger than the tendency to bouncing the striker 101, the rotary drum 105 will not move. If the bounce is stronger the drum 105 and the striker 101 will leave or lift off their support. They will however be able to do so by a very small value only within the range of a few tenths of millimeter the rotary drum 105 being caused to abut the part 131. Furthermore this small lifting off cannot damage the pivots 106 of the drum 105 since they are taking a bearing upon the annular member 108 which is bearing itself upon the resilient washer 102. Under the effect of the drum 105 being lifted off the annular piece 108 will move very slightly forward while elastically deforming the washer 102 and will forthwith move back to its place again in bearing engagement with the upper edges of the notches 107 of the member 130.

Since the return stroke of the inertia block 115 is long its spring 116 is still compressed at the end of this bouncing phenomenon which has thrown forward the drum 105 and the striker 101 over a few tenths of millimeter. The force of the spring 116 still compressed exerted upon the striker 101 moves the latter as well as the drum 105 back to bearing engagement with the portion 110 of the piece 130. This characteristic feature is very important and it enables the drum 105 to be released, freed or disengaged by the striker 101 for turning about its axis consisting of the pivots 106 only after the end of this bouncing phenomenon. It is indeed important that the beginning or initiation of the rotation of the drum 105 be not disturbed by any parasitic or spurious driving pulse such as that caused by the bouncing phenomenon in order that the full revolution of the drum takes place within a given constant time.

The drum 105 should therefore be released with some time lag or delay when the influence of the bouncing phenomenon has had time to vanish.

After this bouncing phenomenon the inertia block 115 keeping moving upwards while pushing the balls 125 back towards the top end of the striker 101 engages or contacts the abutment 135 defining its forward end position. At this time the influence of the spring 116 upon the striker vanishes (FIG. 3). The impact of the inertia block 115 against the abutment 135 drives the striker 101 forward the point or tip 134 of which moves out of the blind hole 112 of the drum 105. The striker 101 is braked and then blocked with its frusto-conical or tapering portion engaging the cylindrical opening 142 of the member 102 so that it is thus tightly retained in clamped outward projecting relationship on the member 102 in the position shown in FIG. 3. (Air venting passageways not shown are provided so that the quick displacements of the inertia block 105 and the striker 101 be not braked). Thus when the front portion of the projectile is not covered with an impact cap (not shown) the shape and flexibility of which vary according to the use of the projectile the striker 101 clamped or tightly held within the frusto-conical opening 142 may not move back under the action of the wind. When an impact cap of the aforesaid kind is used in addition the latter protects from the wind the outside projecting portion of the striker 101. The latter has then an additional tendency to move forward and to remain held there.

When the tip or point of the striker has released the drum 105 the latter is subjected to a gravity force which is approximatively directed along the center line axis of the projectile on its path of travel and which arises from its slowing down itself due to the resistance of the air. Under the effect of this weight or gravity internally of the projectile the drum 105 moves away from the spherical portion 110 and its pivots 106 will be caused to contact or engage the annular part 108 itself bearing upon the member 131 through the medium of the resilient washer 109. The elasticity of this washer 109 is stronger than the thrust of the drum 105. The latter remains suspended on its pivots 106 with extremely reduced frictions in a balanced condition or equilibrium between the portion 110 and the member 131. Since this drum has an eccentric centre of gavity it forms a compound pendulum and revolves about its axis of rotation until its abutment 145 engages the lower edge of the bore 132 of the member 131 as shown in FIG. 3. This motion is effected for a given duration. The abutment 145 of the drum remains bearing upon the part 131 under the action of the inner gravity force prevailing in the body of the projectile.

In this position the detonator 103 is aligned in registering relationship with the point or tip of the striker and leads directly to the charge 104. The arrival of the projectile onto or at a target causes the striker 101 to be suddenly depressed or driven into the body of the projectile the point or tip 134 striking the detonator 103 which immediately fires or ignites the charge 104.

It should be noted that the firing mechanism which has just been described is of an absolutely reliable or dependable operation. It indeed withstands even very strong vibrations and shocks and enables to cock the projectile only when the latter has been shot under satisfactory conditions the cocking step being performed by the rotation of the drum about its axis within a given time after the bouncing phenomenon due to the end of the acceleration on start. Moreover the accidental burst or explosion of the detonator in the safety position cannot ignite the charge because the drum closes in tightly and strongly sealed relationship the passageway leading to this charge.

Moreover the mounting or assembly of this mechanism is performed in a simple manner by stacking the parts one above the other and the resilient element 122 enables in fact to provide a proper tightening or clamping of the inner pieces stacked one above the other. It should moreover be noted that this element could be replaced by a ring-shaped member movable with a set or calibrated friction by an adjusting or set screw or by any other suitable means its function being essentially to compensate for the dimensional irregularities of the stacked parts.

It should be understood that the invention is not at all limited to the form of embodiment described and shown which has been given by way of example only. In particular it comprises all the technical equivalents of the means described as well as their combinations if the latter are carried out according to its gist and used within the scope of the appended claims.

What is claimed is:

1. In a projectile such as a rifle grenade, a firing device comprising a striker placed along the center line axis of said projectile and projecting from the latter at the front end thereof, a detonator associated with said striker and fired by the latter when the front end of the projectile hits upon an obstacle and a charge ignited by the detonator, said detonator being movable between two positions the first one of which is a safety position whereas the second one is an operative working position enabling to ignite the charge, said detonator being kept in said first position by said striker retracted into said projectile and retained by a locking arrangement which is unlocked through inertial effect when the projectile has been shot, wherein said locking arrangement comprises a first inertia block movable within said striker between a front abutment and the bottom of said striker, a calibrated return spring for urging said inertia block towards said abutment, a second cylindrical annular inertia block surrounding said striker within said projectile and movably mounted between a front shoulder and a rear shoulder of the body of said projectile, slots extending through the body of said striker for receiving locking balls held within said slots between said first inertia block and said second inertia block when said striker and detonator are in the safety position before the shooting of said projectile, said first inertia block having, between said front abutment and said bottom of the striker, a relatively very long stroke for uncovering said slots of said striker and releasing said locking balls only at the end of the stroke, so that said locking arrangement on the one hand remains insensitive to very violent and short accelerations such as those induced by a shock before shooting said projectile and on the other hand releases said detonator only after a bounce at the end of a shooting acceleration thereby enabling said detonator to be in an operative working position at the end of a constant and predetermined time period after shooting of said projectile.

2. A device according to claim 1, wherein said second inertia block surrounding said striker has a weight much smaller than that of said first inertia block.

3. A device according to claim 1, wherein a resiliently compressible element is mounted about said striker between said second inertia block and said front shoulder of the body of said projectile.

4. A device according to claim 1, wherein the upper portion of said slots provided in said striker for receiving said locking balls is sloping upwards and inwards of said striker.

5. A device according to claim 1, wherein said second inertia block is bearing upon said locking balls received in said slots of said striker through the medium of surfaces conforming to the rounded shapes of said balls.

6. A device according to claim 1, wherein said striker is slidably mounted in a cylindrical bore of the body of said projectile and projects outwards from the front end of said projectile while being engaged and guided at its front end of cylindrical shape in said cylindrical bore of the body of said projectile, this cylindrical end then converging into a portion of a slightly frusto-conical shape enabling to lock said striker in outward extended position within said cylindrical bore.

7. A device according to claim 1, wherein said detonator is mounted in a central bore opening from a substantially spherical member mounted for rotation about an axis perpendicular to the longitudinal center line axis of said projectile so that said detonator in said second position is caused to be located on the longitudinal center line axis of said projectile and striker and is placed in said first position in perpendicular relation to this axis.

8. A device according to claim 7, wherein said spherical member is formed with a blind hole on its outside surface which is directed radially at right angles to said bore, a point of said striker projecting into this blind hole for keeping said detonator in said first position after shooting of the projectile.

9. A device according to claim 7, wherein the center of gravity of said spherical member is eccentric with respect to the rotation axis thereof so that said member forms a compound pendulum likely to bring the detonator from its second position in a given time.

10. A device according to claim 7, wherein said spherical member includes a pair of radially extending diametrally opposite pivot-like swivel stud pins projecting from its outside surface.

11. A device according to claim 10, wherein said pivots are accommodated in two longitudinal notches provided in the body of said projectile and enabling a slight longitudinal displacement of said spherical member between two radially opposite concave bearing surfaces.

12. A device according to claim 11, wherein the ends of said notches are closed by a movable ring bearing upon a resilient washer itself bearing upon one of said bearing surfaces of said spherical member.

* * * * *